US008779310B2

(12) United States Patent
Keim et al.

(10) Patent No.: US 8,779,310 B2
(45) Date of Patent: Jul. 15, 2014

(54) SWITCHING DEVICE WITH A SWITCHING ELEMENT DRIVEN VIA A FLEXIBLE SHAFT

(75) Inventors: Klaus Keim, Hanau (DE); Michael Mann, Alzenau (DE); Tobias Erford, Zürich (CH); Daniel Kuhl, Frankfurt (DE); David Saxl, Zürich (CH); Peter Klonecki, Frankfurt (DE)

(73) Assignee: ABB Technology AG, Zürich (CH)

( * ) Notice: Subject to any disclaimer, the term of this patent is extended or adjusted under 35 U.S.C. 154(b) by 157 days.

(21) Appl. No.: 13/560,677

(22) Filed: Jul. 27, 2012

(65) Prior Publication Data

US 2013/0186736 A1 Jul. 25, 2013

(30) Foreign Application Priority Data

Jul. 28, 2011 (EP) ..... 11175792

(51) Int. Cl.
*H01H 9/20* (2006.01)
*H01H 11/00* (2006.01)

(52) U.S. Cl.
USPC ..... 200/50.26

(58) Field of Classification Search
USPC ..... 200/50.26, 308, 6 R, 19.18, 43.11, 200/43.13, 43.15, 43.16, 43.19, 43.21, 49, 200/431, 33 R
See application file for complete search history.

(56) References Cited

U.S. PATENT DOCUMENTS 2,441,808 A 5/1948 Fry
5,268,543 A * 12/1993 Ramos ..... 200/43.11
5,466,902 A 11/1995 Blom et al.
8,264,232 B2 * 9/2012 Rival ..... 324/421

FOREIGN PATENT DOCUMENTS

DE 83 36 821 U1 4/1984

OTHER PUBLICATIONS

"High-voltage switchgear and controlgear—part 102: Alternating current disconnectors and earthing switches", IEC 62271-102, International Standard, First edition 2001-12, 191 pages.
European Search Report (EPA Form 1507N) dated Dec. 27, 2011.

* cited by examiner

*Primary Examiner* — Edwin A. Leon
*Assistant Examiner* — Anthony R. Jimenez
(74) *Attorney, Agent, or Firm* — Buchanan Ingersoll & Rooney PC

(57) ABSTRACT

A switching device includes a switching element movable from a first position into a second position, a drive unit producing a rotary movement, and a flexible shaft transmitting the rotary movement to the switching element. The shaft has rotatable input and output sections on input- and output-drive sides, respectively. During movement of the shaft, a first rotary angle is producible at the output section, which first rotary angle is less than a second rotary angle at the input section at the same time, such that a first rotary angle shift is produced. The input section is connected to a switching position detection element having a control means with a first region which corresponds to the first position of the switching element and is coupled to the detection element. An identical indication of the detection element can be achieved in case of different rotary angle shifts in the same electrical switching state.

27 Claims, 5 Drawing Sheets

SWITCHING DEVICE WITH A SWITCHING ELEMENT DRIVEN VIA A FLEXIBLE SHAFT

RELATED APPLICATION(S)

This application claims priority under 35 U.S.C. §119 to European Patent Application No. 11175792.8 filed in Europe on Jul. 28, 2011, the entire content of which is hereby incorporated by reference in its entirety.

TECHNICAL FIELD

The present disclosure relates to a switching device with a movable switching element for opening and closing an electrical contact, it being possible for the switching element to be driven via a flexible shaft, and to a switchgear assembly with such a switching device.

BACKGROUND INFORMATION

A known electrical medium-voltage or high-voltage switchgear assembly includes at least one circuit breaker for opening an electrical connection between two switch poles of an electrical phase during operation of the switchgear assembly, and at least one switching device per electrical phase. The term switching device is understood below to mean grounding switches, switch disconnectors or combined disconnector and grounding switches, in which opening of an electrical connection is performed by a movement of a switching element from a first position into another, second position between two switch poles of an electrical phase of the switching device, usually not during nominal operation of the switchgear assembly.

In the case of many such switching devices, a drive device for moving the movable switching element is arranged on the switch housing or even integrated therein. As a result, in a known switchgear assembly, the switching devices are firstly arranged locally sometimes far apart from one another and are secondly aligned, where possible, differently still relative to one another in three dimensions.

In addition to various specifications such as compliance with the relevant regulations, for example, the IEC Standard 62271-102:2003, customer specifications are also to be met which demand, for example, that the switching position of the switching device is indicated visually to an operator at any time by means of a switching position indication. This is often the case, for example in the case of gas-insulated switchgear assemblies, and in particular results in a complex monitoring procedure, in particular in the case of switchgear assemblies requiring a large amount of space, when a plurality of switching positions need to be monitored visually by an operator. Assemblies are known in which this problem is solved via an electronic switching position indication, whereby an input drive shaft position corresponding to a predetermined switching element position is communicated electronically to a display close to the user. However, this second solution does not meet the customer specification for an uninterrupted mechanical chain between the switching element and the switching position indication. Moreover, in the event of a fault, for example in the event of failure of the secondary current system, the operator is no longer provided with any more information on the switching state, such as the switching position of the movable switching elements of the switches relative to the switching poles. This is typically not tolerated by the operator of a switchgear assembly since the indication of the switching position of electrical devices represents a safety-relevant criterion.

One possible way of improving the situation consists in the switching element being moved from a location remote from the actual switch via a flexible shaft.

U.S. Pat. No. 5,466,902 has disclosed a switching apparatus in which a movable switching element of a switching device is fixedly connected to a switching lever via a flexible shaft, with the result that the switching element can be operated by a switching lever from an operating region with a remote location from the switching device. The switching lever is fixedly connected to a rotatable input section of the flexible shaft, and the switching element is fixedly connected on the output-drive side to one rotatable output section, with the result that the movable switching element can be moved over from a first position into a second position.

The inclusion of a flexible makes it possible to overcome, in a structurally simple manner, mass and position tolerances between the input section and the output section and, thanks to the different orientability or alignability of the input section and the output section, contributes to considerable design freedom.

With the flexible shaft, however, as the switching element leaves the first position, for example, when a greater use of force on the switching lever is required than when the switching element is moved merely between the first and the second position. This greater use of force results from an adhering effect of contact elements, which may be arranged on the movable part of the nominal contact transition. As the use of force increases, a rotary angle shift, which can be generated by a first rotary angle of the flexible shaft at the output section and a second rotary angle at the input section at the same time, becomes greater. If torque is now introduced into the switching lever, it may arise, depending on the torsional strength of the flexible shaft, that, when the first position of the switching element is left, the switching lever is already in a position which corresponds to a switching position of the switching element between the first and second positions, while the switching element, from an electrical point of view, is still in the first position. Since the operator of a switching device always needs to know, simply for safety reasons, whether a switching element is still located in a certain electrical position or not, such a state is unfavorable, if not completely insupportable.

Depending on the embodiment of the switching device, the drive torque for the movable switching elements of such switching devices is approximately 10 Nm, for example. Depending on the embodiment of the flexible shaft, a rotary angle shift between the input section and the output section during the introduction of a torque of a few Newton meters at the input section can suddenly be greater than 30° (degrees), for example, 60° or even greater, at a length of the flexible shaft of approximately 2 meters. As the length of the flexible shaft increases, the rotary angle shift increases. This is associated with the uncertainty as to whether the switching element is now already in the desired switching state or whether it is still in one switching position during the preceding switching state. This lack of certainty is insupportable both technically and in terms of safety.

SUMMARY

An exemplary embodiment of the present disclosure provides a switching device which includes a switching element configured to be moved from a first position into a second position, a drive unit configured to produce a rotary movement, and a flexible shaft configured to transmit the rotary movement to the switching element. The flexible shaft has a first length and is mounted so as to enable rotary movement and includes a rotatable input section on an input-drive side, and a rotatable output section on an output-drive side. The input section is connected to the drive unit. During movement of the flexible shaft between the first position and the second position of the switching element, a first rotary angle is produced at the output section which is smaller than a second rotary angle at the input section at the same time, such that a first rotary angle shift is producible. During movement of the flexible shaft when the first position is reached, a third rotary angle is produced at the output section, the third rotary angle being smaller than the second rotary angle at the input section at the same time, such that a second rotary angle shift which is greater than the first rotary angle shift is producible. The exemplary switching device also includes a switching position detection element and a mechanical first intermediate gear. The input section is connected to the switching position detection element via the mechanical first intermediate gear. The first intermediate gear includes a control means with a first region, which corresponds to the first position of the switching element and which is coupled to the switching position detection element such that the first rotary angle shift and the second rotary angle shift in a predefinable electrical switching state of the switching device result in an identical indication of the switching position detection element.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
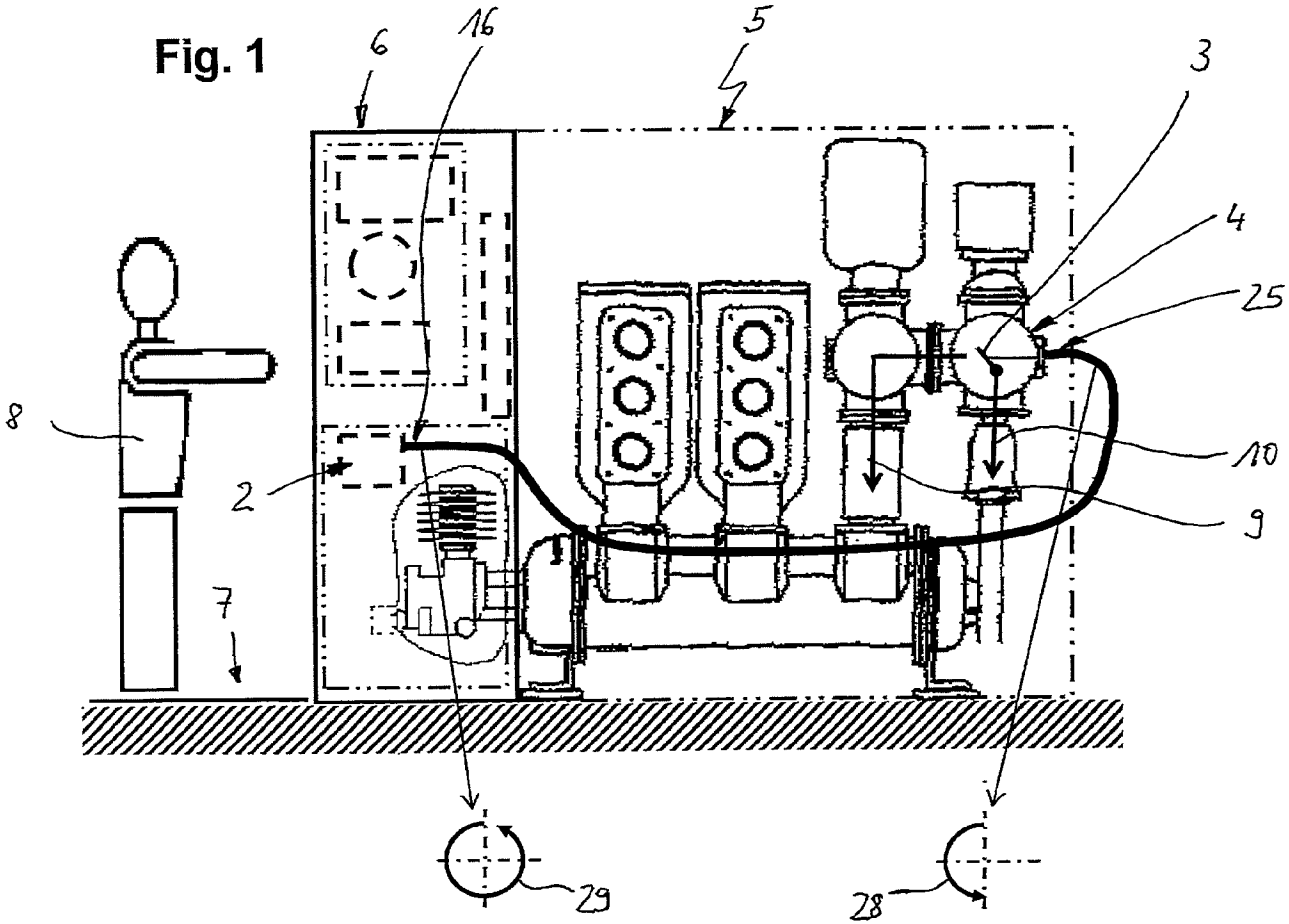
FIG. 1 shows a side view of a gas-insulated switchgear assembly with a switch in a partial section, and an illustration of a first rotary angle and a second rotary angle in a switching position of the switching element between the end positions, according to an exemplary embodiment of the present disclosure.

Exemplary embodiments of the present disclosure provide a switching device which indicates more reliably to a user whether the switching element driven via a flexible shaft, for example on leaving the first position, is still electrically in the first switching state or whether it has already left the first position and therefore another switching position prevails.

The term switching device will be understood below not to mean circuit breakers such as gas-insulated circuit breakers, generator switches or the like, but to mean switches which involve a comparatively low drive power.

In accordance with an exemplary embodiment of the switching device, the switching device includes a switching element which can be moved from a first position into a second position. In addition, the switching device includes a drive unit for producing a rotary movement and a flexible shaft for transmitting the rotary movement to the switching element. The flexible shaft has a first length and is mounted such that it can perform a rotary movement. The flexible shaft has a rotatable input section on the input-drive side, and a rotatable output section on the output-drive side. The input section is connected to the drive unit producing the drive force. During the movement of the flexible shaft when the switching element is located between the first position and the second position, which is different than the first position, a first rotary angle can be produced at the output section, which first rotary angle is smaller than a second rotary angle at the input section at the same time. The difference between these two rotary angles is the basis of a first rotary angle shift. During movement of the flexible shaft when the switching element reaches the first position, a third rotary angle can be produced at the output section. This third rotary angle is smaller than the second rotary angle at the input section at the same time, with the result that a second rotary angle shift can be produced which is greater than the first rotary angle shift. The input section is connected to a (for example, likewise mechanical) switching position detection element via a mechanical first intermediate gear. The first intermediate gear has a control means with a first region, which corresponds to the first position of the switching element or is associated therewith. This first region is coupled to the switching position detection element in such a way that the first rotary angle shift and the second rotary angle shift result in an identical indication of the switching position detection element. In this case, an identical indication of the switching position detection element corresponds to a switching state, for example "disconnector closed" or "disconnector completely open".

An identical indication is important both in the case of purely mechanical reading and in the case of electrical reading of the switching state since the information on the switching state of a switching device is often used as an input for switching logic which prevents, for example, a further switching device from being able to implement a specific switching operation at all. In other words, the knowledge of the switching state of a switching device is not only important for fault-free operation of a switchgear assembly but also when switchgear assembly parts intended, for example, for inspection or maintenance purposes, can be switched safely and absolutely reliably in current-free fashion.

The term "first position" or "second position" will be understood below to mean a mechanical position or a geometric location into which the movable switching element can be brought.

The term "switching position" will be understood below merely as the electrical switching position, namely the electrical switching state. In accordance with an exemplary embodiment of the switching device as a disconnector, the switching device has two defined switching states, namely "disconnector closed" or "disconnector completely open", wherein the position of the switching element relative to the switching poles can be as follows:

Completely open (in end position)

Completely closed (in further end position)

Anywhere between these two end positions.

Such a switching device can be used, for example, as a disconnector or grounding switching (earthing switch).

If the switching device is not one basic embodiment, but includes a plurality of electrical switching positions, such as in the case of a combined disconnector and grounding switch, for example, the following switching states are possible:

Completely open (in the first end position)

In a predefined mid-position

Completely closed (in the second end position)

Anywhere between the first end position and the mid-position

Anywhere between the second end position and the mid-position.

All of these embodiments of switching devices have the common feature that the switching element can be moved within certain limits without the electrical switching position, namely the electrical switching state, and correspondingly the indication being changed. In other words, a switching device is located electrically in the closed position as soon as the movable switching element impinges on a mating contact, for example a fixed contact. The actual position of the switching element in this case still corresponds to the end position of the switching element in this switching position, however, since this switching position is only reached once the switching element has moved further in the same direction at a later time. In the meantime, a switching element in the form of, for example, a linearly movable pin contact presses the contact elements together between the pin contact and the mating contact. In order for the contact elements to be pressed together, during the insertion process an amount of force needs to be applied in order to overcome a counterforce produced by the contact elements (for example laminated contacts), but this has no effect on the electrical switching state.

By way of summary, the movable switching element in the same electrical switching state actually has a plurality of possible mechanical positions, for example between the first electrical contact-making position and the point at which the first provided end position is reached.

The same applies correspondingly when the pin contact is withdrawn from the tubular mating contact, with the contact elements exerting an "adhering effect" on the pin contact.

Due to the first intermediate gear, it is possible to accommodate the effect of the rotary angle shift, and deviations between different rotary angle shifts, as occur, for example, as a result of flexible shafts of the same type but with different lengths, and production-related tolerances of the auxiliary contacts, with the result that deviating electrical switching indicating position representations and therefore incorrect indication of the actual electrical switching state do not occur.

The mechanical first intermediate gear fulfills the requirement that the drive unit and the switching device do not contain any electronic components, as are otherwise generally used as a rule. Instead, the first intermediate gear in general and its control means in particular are configured in such a way that they are mechanically "soft", for example, owing to the flexible shaft acting as torsion spring, largely an image of the actual switching state is simulated on the output-drive side of the flexible shaft in the case of the switching element, without any adjustment for compensating for the torque shift of the flexible shaft being involved in the process.

Furthermore, the mechanical first intermediate gear meets the specifications of IEC 62271-102:2003 by virtue of a mechanical connection always being provided between the switching element and the switching position detection element. Depending on requirements, the switching position detection element can be in one or more parts and can serve to trigger one or more auxiliary contacts. In this case, an uninterrupted electromechanical, kinematic chain between the switching element and the auxiliary contact can be achieved. In this case, the indication can be read or determined electrically via auxiliary contacts, as required, when the switching position detection element for its part drives one or more auxiliary contacts directly or via a further auxiliary gear.

Depending on the embodiment of the switching device, the movable switching element is, for example, a rotatable contact piece or a retractable contact piece, also referred to as a switching pin.

In accordance with an exemplary embodiment, the switching device is characterized by the fact that its control means has a second region corresponding to the second position of the switching element. This second region is in this case coupled to the switching position detection element in such a way that the first rotary angle shift and the second rotary angle shift result in a further indication of another switching position, but in that second switching position nevertheless results in a respectively identical indication of the switching position detection element for the second switching state.

Similarly, this applies correspondingly also to switching devices which have more than two switching states, for example combined disconnector and grounding switches with three defined switching states.

The greater the first and/or the second region(s) of the control means is/are, the greater the tolerances of the switching position detection element and/or possible elements associated therewith, such as auxiliary switch or auxiliary contacts, can be.

For example, when the switching device is part of a relatively large and therefore dimensionally unclear switchgear assembly or when the switching device is intended to be operable from a control unit which is arranged spatially far removed from the switching device, an embodiment of a drive unit which comprises an electric motor is recommended. This electric motor transmits the torsion required for switching the switching element to the input section of the flexible shaft, for example via a secondary gear. If required, for example owing to safety regulations during the emergency operating mode, the drive unit is additionally or alternatively also manually operable. For this purpose, the input section of the flexible shaft itself, or a spindle of a secondary gear mechanically connected thereto can have a plug-coupling for accommodating a hand crank.

As has already been mentioned previously, it may be necessary for it to be possible for the indication of the switch position detection element to be tapped off at the auxiliary contact in the form of an electrical signal, for example in order for this signal to be supplied to switching logic or a switchgear assembly controller. For this purpose, the switching position detection element is connected, for example, to at least one auxiliary contact in such a way that an indication of the switching position detection element corresponding to the first position of the switching element, for example, the switching state, must be capable of being tapped off as an electrical signal at the auxiliary contact.

The same applies correspondingly when a second switching contact or a plurality of switching states are intended to be capable of being read electrically, for example in the case of a combined disconnector and grounding switch.

Depending on requirements, the at least one auxiliary contact can have a contact element capable of rotating about a spindle. In accordance with an exemplary embodiment of an electromechanical detection of the switching state, this spindle is formed by the switching position detection element itself. If required, a further (linear) intermediate gear between the switching position detection element the spindle bearing the contact element is possible.

Particularly when the auxiliary contacts, for example owing to their construction, require a nonlinear, for example, discontinuous, jerky triggering, a switching device is recommended in which the first intermediate gear is a nonlinear gear, with which the switching position detection element can be triggered nonlinearly with respect to the second rotary angle of the input section. Nonlinear switching of the auxiliary contacts may be required because this results in a sufficiently high switching speed to the electrical contacts of the auxiliary contacts, with the result that even in the case of undervoltages (slowest possible triggering of the auxiliary contacts) and in the case of overvoltage (quickest possible triggering of the auxiliary contacts), reliable switching of the auxiliary contacts is ensured. A further advantage of the use of a nonlinear gear consists in that the jerky switching of the auxiliary contacts when a desired position is reached prevents the contact tongues of the auxiliary contacts from remaining adhered to the mating contact ("sticking"), for example as a result of a welding effect. Depending on the embodiment of the auxiliary contacts, the auxiliary contacts have a rotatable contact element and a stationary contact region. The rotatable contact element wipes over the contact region in the circumferential direction. The length of the contact region is manufactured during fitting of the auxiliary contact and can therefore sometimes be subject to considerable deviations from the ideal mass and/or the ideal shape. By virtue of a corresponding configuration of the region of the control means, the effects of such tolerances can largely be compensated for, however.

At this juncture, a slotted-link control mechanism is mentioned as an example of a very reliable, low-maintenance triggering of the actuating means with a first region, a second region and possibly further regions with the switching position detection element. In accordance with an exemplary embodiment of the slotted-link control mechanism, a switching journal is guided in a slot, or the slot guides a switching journal. In other words, the control means comprises a slotted-link control mechanism. Depending on the embodiment of the control means, the control means can itself again be a slotted-link control mechanism, for example for converting a linear movement back into a rotary movement. In the normal case, slotted-link control mechanisms are inexpensive owing to their simplicity and can be produced economically. If required, a lever mechanism can also be used instead of the slotted link or in combination therewith. Furthermore, the control means or at least one region thereof is also mounted rotatably. Moreover, the slotted-link control mechanism can also be formed in more than one part, for example can be assembled from a plurality of parts. Even in the case of such an embodiment, in the case of a switching device whose switching element identifies two defined switching states, primarily the size and shape of the end positions of the slotted-link control mechanism are decisive.

In order to be able to use the drive mechanism with the drive unit of the switching device for driving flexible shafts of different lengths without any adjustment work being required, the control means can be designed in such a way that, even when using a flexible shaft with a second length which is different than the first length and therefore with a first rotary angle shift with a different magnitude and a second rotary angle shift with a different magnitude, again an identical indication of the switching position detection element and therefore of the predefinable switching state results. At this juncture, a slotted-link control mechanism is mentioned as a representative of a large number of possibilities of such a tolerance to altered rotary angle shifts, the slot of the slotted-link control mechanism in a section corresponding to a switching state being so long and/or having such a shape that a certain rotary angle shift region can be covered thereby without the indication of the switching position detection element changing. In simplified terms, the slotted-link section forming the rotary angle shift region in this case forms an overflow in terms of control technology.

If the first intermediate gear is intended to convert a rotary movement which can be produced by the drive unit at the input section into a linear movement, the first intermediate gear can have at least one spindle/driver nut combination.

If required, when the first position or the second position of the switching element is reached, at least one (electrical) limit switch is actuable via the driver nut of the spindle/driver nut combination, for example, a limit switch with which the event of a predefinable position being reached is electrically readable or detectable and transmittable. Depending on the embodiment, the limit switch can be formed by a further auxiliary contact.

It is also conceivable for the limit switch to be arranged relative to the driver nut of the spindle/driver nut combination in a fitting position which is selected depending on a rotary angle shift characteristic, in particular a total length, of the flexible shaft. This fitting position can be taken, for example, from a table of corresponding tested, different lengths of the flexible shafts of this type or even of different types, for example from different manufacturers.

A typical flexible shaft is designed to transmit a rotary movement in a direction of rotation. If it is nevertheless operated in the opposite direction, the torsional spring response and therefore the rotary angle shift is often different such that they are not suitable for use in a switching device. This is not so in the case of the switching device according to the disclosure, which is characterized by the fact that the flexible shaft has at least two litz-wire layers with a different winding direction, which litz-wire layers are provided in such a way that, given an identical second rotary angle, the first rotary angle shift or the second rotary angle shift during operation of the flexible shaft in the clockwise direction deviates from the first rotary angle shift or the second rotary angle shift during operation of the flexible shaft in the counterclockwise direction by less than 20%. This can be achieved, for example, by a correspondingly selected right-to-left ratio of the litz wires, a different choice of material, a different number of litz wires per litz-wire layer, litz-wire diameters of different magnitudes per litz-wire layer or a combination of these possibilities. Furthermore, it is accordingly advantageous when the flexible shaft is protected by an armored sheath and nevertheless provides the possibility of a small minimum bending radius. The latter influences the ease of laying the flexible shaft considerably.

Furthermore, it may be advantageous if the drive unit is not permanently fixedly connected to the switching element, but is coupled detachably to the switching element. One advantage of this capacity for coupling comes to light, for example, when the drive mechanism impinges on the associated switching element on one side of the flexible shaft only at the location where the switching device is first brought into operation. In such a case, the switching device is characterized by the fact that the input section and/or the output section of the flexible shaft have a detachable further coupling. Toothed couplings are particularly suitable since they allow very precise joining and coupling of the flexible shaft to the switching element and the drive unit, particularly when the latter are located in predetermined basic settings. The smaller the angle from tooth to tooth, the more precisely the flexible shaft can be positioned relative to the input-drive-side end of the input section and more precisely coupling to the switching element, in a predefinable initial position, at the output-drive-side end of the output section can be implemented. As a result, the flexible shaft can also be used as an adjusting element.

Be that as it may, other types of coupling, such as, for example, a polygon shaft coupling, a spline joint or even a flange can also be used as an alternative. It is important that the torque introduced onto the input section of the flexible shaft by the drive unit can be transmitted as far as possible without any play in the circumferential direction relative to a neutral axis of the flexible shaft.

Flexible shafts have the property of increasing rotary angle shift as the torque loading increases. This property is disadvantageous in particular when using electric motors as the drive unit. In addition, electric motors have the disadvantage that, in comparison with the rotation speed required at the switching element, they have an excessively high rated rotation speed to be able to produce the rated power. Therefore, particularly when using an electric motor as the drive unit for moving the switching element, a switching device should be provided which is characterized by the fact that a mechanical second intermediate gear is arranged on the output section of the flexible shaft. In this case, the second intermediate gear is a reduction and has an input connection and an output connection, it being possible for a rotation speed of the output connection to be reduced with respect to a rotation speed of the input connection by means of the second intermediate gear. This second intermediate gear makes it possible to keep the rotation speed of the flexible shaft as high as possible, as a result of which the shaft only needs to transmit comparatively little torque, which results in a smaller rotary angle shift than when a comparatively higher torque is intended to be transmitted in the case of the same power transmission but a low rotation speed. The second intermediate gear transforms from this a small rotation speed with a high torque, as is required in general at the switching element. As a result, a very compact drive train can thus be realized. If required, the second intermediate gear is an angular gear.

When it is intended to connect an optical switching position indication mechanically directly to the switching element in accordance with IEC standards, the switching device is characterized by the fact that, for example, the drive train has an optical switching position indication which is connected in rotationally fixed fashion to the first intermediate gear.

In respect of the installation and operation of switchgear assemblies, advantageous solutions can be achieved with gas-insulated switching devices, in which the switching element is arranged so as to be electrically insulated from a metal-encapsulated housing of the actual switch by an insulating gas. This is particularly advantageous for gas-insulated switchgear assemblies, whose switching elements are often arranged spatially several meters apart at locations in a switch panel which are sometimes difficult to access. The spatial separation of the switching element and the drive unit also provides the possibility of, for example, an arrangement of the drive unit in the control cabinet of the switchgear assembly while the actual switch is arranged somewhere in the switchgear assembly itself. As a result, it is also possible with the present disclosure to simulate the uninterrupted mechanical chain, also referred to as a kinematic chain, optically in a very simple manner, for example by virtue of a display glass of the drive arranged behind a cover of the control cabinet interrupting the cover locally and thus providing a user with the possibility of direct visual access to the switching position indication.

A further advantage of the flexible shaft consists in that, even in the case of alignments of the switching device which are shifted and/or rotated about the axes of the orthogonal alignment system, namely in three dimensions, a mechanical connection to the movable switching element which can be realized comparatively easily and is reliable is made possible. A reliable view into the switching position indication which is accessible easily to the user at an ergonomically preferred position can be realized with the switching device according to the disclosure even when the switch containing the switching element is installed remote from the user in a position in the switchgear assembly which is only difficult to access. A largely free arrangement of the switching device in the three-dimensional space of a switchgear assembly contributes considerably to the flexibility in use of switching devices arranged with flexible shafts.

In addition, the flexible shaft provides the usability of the switching device and the drive thereof with a very high degree of freedom. Thus, for example, the shape and/or position and/or mass deviations between the drive unit and the switching element/switch can be compensated for by the flexible shaft in an uncomplicated manner. In other words, the flexible shaft provides the possibility of a largely free laying procedure, for example between the control cabinet and a switchgear assembly with such a switching device.

As regards the switchgear assembly, the object is achieved in that the switchgear assembly has at least one switching device according to the disclosure. The advantages mentioned in connection with the switching device apply correspondingly also to such a switchgear assembly.

Although the abovementioned disclosure will be explained below primarily using the example of a gas-insulated switchgear assembly (GIS), in particular a high-voltage switchgear assembly or a switching device thereof, the disclosure can be applied correspondingly in principle also to switching devices in connection with a dead tank breaker (DTB), a live tank breaker (LTB) and air-insulated switchgear assemblies (AIS).

Figure 5:
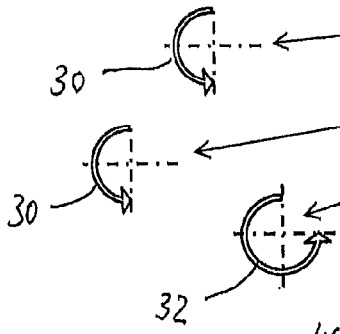
FIG. 5 shows an illustration of the rotary angle shifts and the actual mechanical position of the switching journal in a slotted link shown in FIG. 3, according to an exemplary embodiment of the present disclosure.

It is clear from FIG. 1 that, thanks to a flexible shaft 1 and a drive 2 associated therewith, it is possible to arrange a switching element 3 of a switching device 4 in a location which is locally remote from the actual drive 2 of the switching element 3 and nevertheless to be able to ensure reliable operation of a switchgear assembly 5. FIG. 5 shows a side view of a gas-insulated switchgear assembly with a switching device 4 illustrated in stylized form in partial section, with only one electrical phase being illustrated.

The flexible shaft 1 comprises a part which is mounted so as to be capable of performing a rotary movement and a part which is static during operation of the flexible shaft and which is formed by an armored sheath.

The drive 2 is arranged in a drive cabinet 6. The drive cabinet 6 directly adjoins a control aisle 7, with the result that an operator 8 of the switchgear assembly has optimal access to and an optimum optical view of the drive 2. The switching device has a switching element which can be moved from a first predefinable position into a second predefinable position. In this case, the switching device 4 is a disconnector, with which a first nominal conductor 9 of an electrical phase (R, S or T) can be electrically connected or disconnected from a second nominal conductor 10 of a corresponding electrical phase. The switching-element-side ends of these nominal conductors form the switching poles. Typically at least one disconnector or switching device of this type is used per electrical phase.

Figure 2:
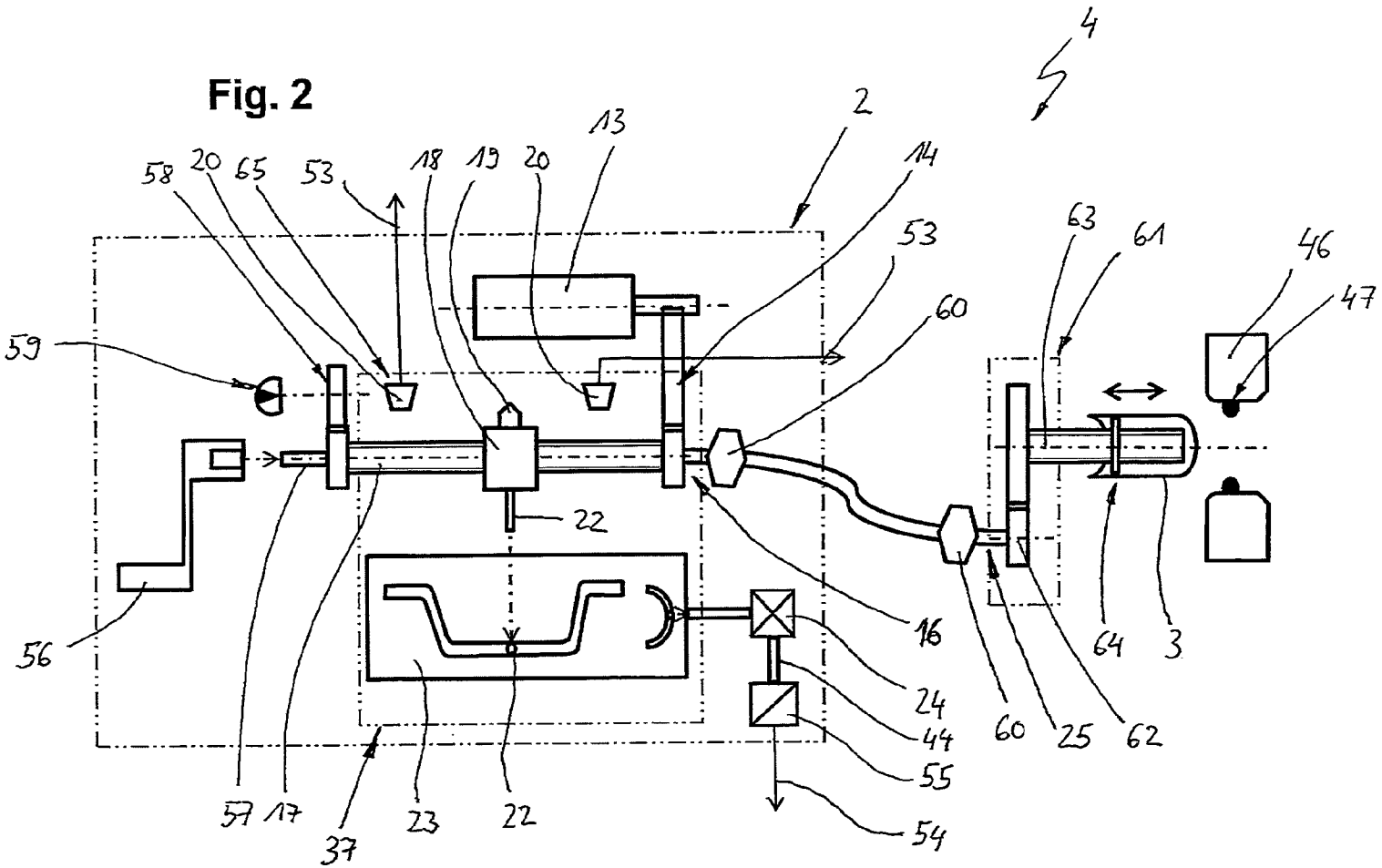
FIG. 2 shows the schematic design of an exemplary embodiment of the switching device.

As can be seen from FIG. 2, the switching device 4 itself has a drive 2 with a drive unit 13 for producing a rotary movement of the flexible shaft 1 and for the purpose of transmitting the rotary movement to the switching element 3. The drive unit 13 comprises an electric motor, which is connected to a rotatable input section 16 of the flexible shaft 1 via a first secondary gear 14. The input section 16 for its part comprises a spindle 17. This spindle 17 is movably connected to a driver nut 18, with the result that a revolution of the spindle causes a linear movement with a length corresponding to the pitch of the threaded spindle 17. The driver nut 18 has a switching cam 19 for interacting with limit switches 20. The driver nut 18 also has a switching journal 22, which engages in a slot in a control means 23 in the form of a slotted link 23 which is mounted movable in the transverse direction with respect to the switching journal 22. This slotted link 23 for its part triggers a switching position detection element 24 mechanically, with the result that the drive unit 13 and the switching element 3 are combined ultimately via a kinematic chain of exclusively mechanical components and is connected to the switching position detection element 24. The slotted link 23 is shown in a position rotated through 90° with respect to the switching journal 22 in FIG. 2, for reasons of understandability.

On the output-drive side, for example, on the side of the switching element 3, the flexible shaft 1 has a rotatable output section 25. During movement of the flexible shaft 1 in the case of a mechanical position of the switching element between a first position 34 and the different second position 33, a first rotary angle 28 can be produced at the output section on the flexible shaft at time t2, t3 (up to shortly before t4), which first rotary angle 28 is smaller than a second rotary angle 29 at the input section 16 at the same time (t2, t3), with the result that a first rotary angle shift 30 is produced (see in this regard FIGS. 3 to 5 in conjunction with FIG. 2).

Furthermore, during a movement of the flexible shaft 1, when the first position 34 is reached at time t5, a third rotary angle 31 can be produced at the output section 25, which third rotary angle 31 is smaller than the second rotary angle 29 at the input section at the same time, with the result that a second rotary angle shift 32 is produced which is greater than the first rotary angle shift 30 (see in this regard FIGS. 3 to 6 in conjunction with FIG. 2).

The input section 16 of the flexible shaft 1 is connected to the switching position detection element 24 via a mechanical first intermediate gear 37, the first intermediate gear 37 comprising, in the embodiment shown in FIG. 2, the threaded spindle 17, the driver nut 18, the switching cam 19, the limit switches 20, the switching journal 22 and the slotted link 23 forming the control means. The control means 23 further has a first region 38, which corresponds to the first position of the switching element 3 and is coupled to the switching position detection element 24 in such a way that the first rotary angle shift 30 and the second rotary angle shift 32 result in an identical indication of the switching position detection element 24 and therefore indicate the same electrical switching state. Further details will be given in relation to the technical effect of such an indication in connection with the corresponding switching state with reference to FIGS. 3 to 6. Before further details are given in respect of the remaining features of the schematic design of this embodiment of the switching device, the way in which the switching device according to the disclosure functions will first be provided.

Figure 3:
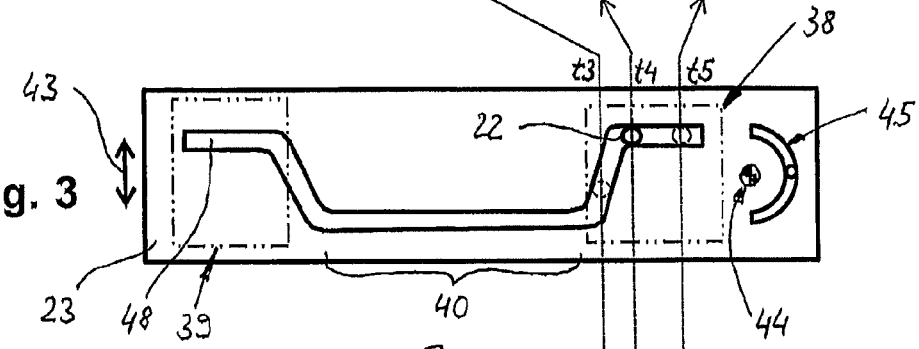
FIG. 3 shows a control means for two electrical switching positions which can be detected clearly, according to an exemplary embodiment of the present disclosure.

FIG. 3 shows a control means 23 for two electrical switching positions (switching states) which can be detected clearly. In order to be able to explain the effect of the first intermediate gear better, the switching journal has been illustrated by a line at time t4 and merely illustrated in stylized form at times t3 and t5. As mentioned above, the switching journal 22 shifts the slotted link 23 depending on the switching state laterally in the direction of the double arrow 43. The switching journal 22 and the slotted link 23 together form a slotted-link control mechanism. In order to produce a rotary movement from this linear movement of the control means 23 for a switching position detection element which is capable of rotating about a stationary rotary spindle 44, the control means 23 is connected to the switching position detection element 24 via a further slotted-link control mechanism 45. Only an arcuate slot path and a triggering journal of the further slotted-link control mechanism 45 are illustrated in FIG. 3 for reasons of clarity.

Since it is necessary to detect two electrical switching states in the case of the switching device in the form of a disconnector, the slotted link 23 has a second region 39 associated with the second switching state, in addition to the first region 38 associated with the first switching state. A connecting region 40 located therebetween connects the first and second regions 38, 39 and represents an electrical intermediate position between the switching poles, in which intermediate position the switching element 3 is located mechanically between the first end position (disconnector completely closed) and the second end position (disconnector completely open).

Figure 4:
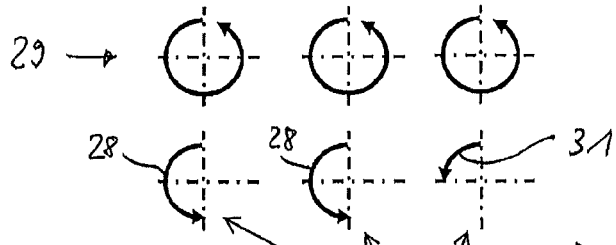
FIG. 4 shows an illustration of a first rotary angle and a second rotary angle at in each case the same time given the same switching state, but different local positions of the movable switching element relative to a fixed mating contact, according to an exemplary embodiment of the present disclosure.
Figure 6:
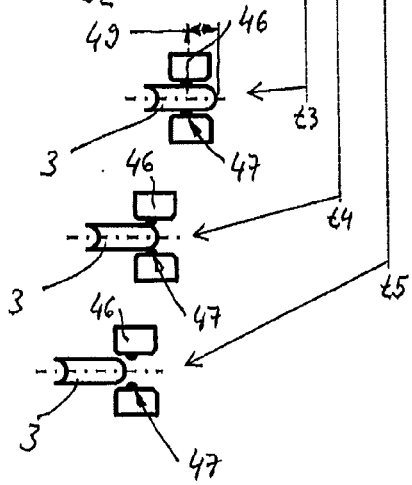
FIG. 6 shows an illustration of the switching state, which changes depending on the actual mechanical position of the switching pin in the slotted link shown in FIG. 3, according to an exemplary embodiment of the present disclosure.

FIG. 4 shows an illustration of a first rotary angle and a second rotary angle at in each case the same time t3, t4 and t5 given the same switching state in the region 38, but different local positions of the movable switching element relative to the fixed mating contact (see FIG. 6).

FIG. 5 shows an illustration of the resultant rotary angle shifts and the actual mechanical position of the switching journal in the slotted link as shown in FIG. 3 at times t3, t4 and t5.

FIG. 6 shows an illustration of the switching state, which changes depending on the actual mechanical position of the switching journal in the slotted link shown in FIG. 3, at times t3, t4 and t5. It is apparent from FIGS. 3 to 5 in combination that the rotary angle shift is substantially constant between times t3 and t4 since the switching element 3 up to this point still does not encounter any resistance since the switching element up to this point in time has not yet reached the mating contact 46 associated therewith. From an electrical point of view, the switching element of the switching device is located in the transition from an open position to the closed position. Since the direction of rotation of the threaded spindle is known, on the other hand, and it is known that the defined switching state imaged by the second region 39 has clearly been left, the user of the switching device knows by virtue of the indication that the switching element is located in an intermediate position between two end positions. At time t4, the switching element 3 impinges on contact elements 47 of the mating contact 46, which ensure reliable transmission of the electrical power in the case of a switch position in the first electrical switching state corresponding to the first region 38. Although the switching element 3 in the form of a pin contact has not yet moved completely into the mating contact 46, from now on another electrical switching state has nevertheless already been reached, with this electrical switching state being correctly reproduced by the first intermediate gear via the indication of the switching position detection element. This correct reproduction is also achieved by a corresponding matching of the switching states and the position of the switching journal 22 in the slotted link 23. If required, the edge of the slot curve path 48 between the connecting region 40 and the first region 38 can be shifted towards the second region in order to ensure that the switching state "closed" by the enlarged first region 38 during the transition from the open position to the closed position slightly earlier in time the switching state "closed", for example, before the switching state has actually occurred in time.

Figure 7:
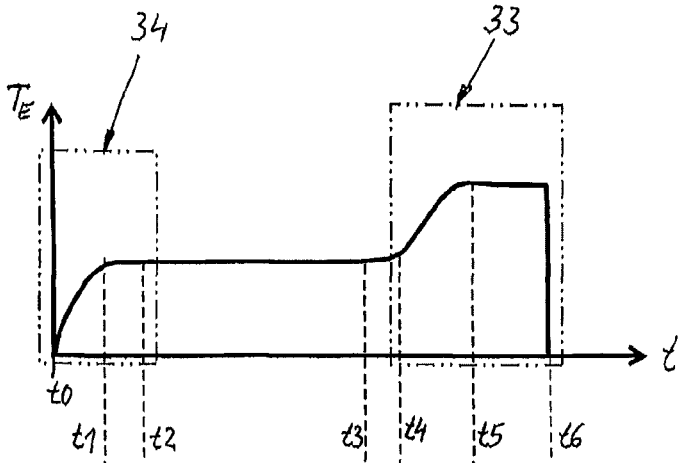
FIG. 7 shows a torque/time graph, which reproduces an introduction of torque into the input-drive-side input section of the flexible shaft from a first switching position (switch completely open) into a second switching position (switch completely closed), according to an exemplary embodiment of the present disclosure.
Figure 8:
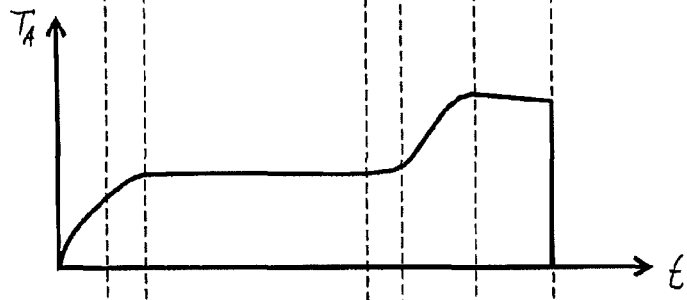
FIG. 8 shows a torque/time graph, which reproduces an introduction of torque into the switching-element-side output section of the flexible shaft at the times corresponding to those in FIG. 6, according to an exemplary embodiment of the present disclosure.

Furthermore, FIG. 5 in combination with FIGS. 6 to 8 shows that the torque shift 32 for overcoming the contact forces of the contact elements 47 (for example laminated contacts) is at its greatest at time t5. This is because, in order to overcome the contact forces of the contact elements 47, the pin contact 3 needs to be pushed or moved forwards with a greater force than at the time between t2 and t3. Correspondingly, the torque requirement at the output section 25 of the flexible shaft is at its greatest at this time t5.

When using flexible shafts of different lengths but of the same type, rotary angle shifts of different magnitudes can occur, but these should nevertheless not result an altered indication by the switching position detection element. As a result of rotary angle shifts of different magnitudes, in the case of the pin contact shown in FIG. 5, excursions of different magnitudes occur, which need to be accommodated. This can take place, for example, by an overflow region 49 for the pin contact, with the result that the switching element can be inserted to a greater or lesser extent into the overflow region 49 of its mating contact 46 during operation of the switching device.

FIG. 7 shows a torque/time graph, which reproduces an introduction of torque $T_E$ into the input-drive-side input section of the flexible shaft from a first switching position (switch completely open) into a second switching position (switch completely closed), while FIG. 8 reproduces a torque/time graph, which reproduces an introduction of torque $T_A$ into the switching-element-side output section of the flexible shaft at the times corresponding to those in FIG. 7.

Between times t5 and t6, the force expenditure for moving the pin contact 3 in this embodiment of the switching device remains to a certain extent constant (likewise for the rotary angle shift), because the contact forces of the contact elements 47 press the pin contact 3 firmly against the lateral surface thereof and thus produce a mechanical adhering effect as a result of the applied friction. Correspondingly, the required torque at the output section of the flexible shaft is the same or at least hardly changed.

Figure 9:
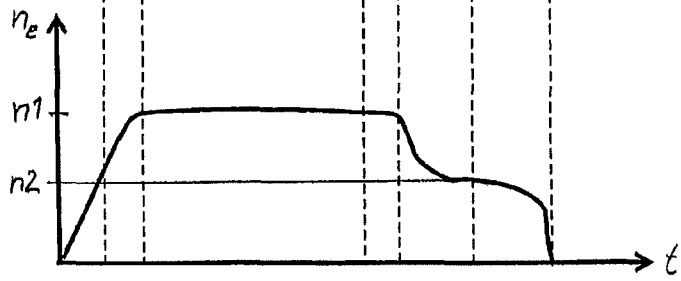
FIG. 9 shows a rotation speed/time graph, which reproduces a rotation speed of the input-drive-side input section of the flexible shaft at the times corresponding to those in FIG. 6, according to an exemplary embodiment of the present disclosure.

FIG. 9 shows a rotation speed/time graph, which reproduces a rotation speed $n_E$ of the input-drive-side input section of the flexible shaft at the times corresponding to those in FIGS. 4 to 8. During runup of the drive unit at time t0 to time t1, the rotation speed increases continuously to a rated rotation speed n1 until the flexible shaft acting as torsion spring is prestressed so as to be operation-ready. The output section up to this point remains largely at a standstill, in simplified terms, provided that the time shift between t0 and t1 is small and the inertia of the flexible shaft is great. At time t2, the output section then also moves corresponding to the input section with the rated rotation speed n1. As soon as the pin contact 3 impinges on the resistance of the contact elements 47 of the mating contact 46, the rotation speed reduces to a second rotation speed value n2 and then to a certain extent remains constant until an end position envisaged for this pin contact is reached and decreases completely once the drive unit has been disconnected.

In any case, a reverse rotation of the input section of the flexible shaft together with the motor then takes place because the output-drive-side end section of the flexible shaft is held firmly via the contact forces of the contact elements 47 acting on the switching element, while the input-drive-side input section springs back when the load is relieved on the flexible shaft acting as torsion spring and therefore rotates the input section back through the rotary angle shift. This applies under the proviso that the drive unit is not electrically or mechanically braked when the end position of the switching element 3 is reached. As a result, this back-rotation of the flexible shaft acting as torsion spring can be absorbed by a corresponding configuration of the first and second regions 38, 39 of the control means 23, with the result that there is no unintentional change in the indication by the switching position detection element.

Coming back to FIG. 2, details will once again be given below of the schematic design of this embodiment of the switching device. As is mentioned in connection with FIG. 3, the switching position detection element 24 is connected mechanically to the slotted link 23 via a further slotted-link control mechanism 45. In order to be able to tap off electrically and transmit the switching position of the switching device, the switching position detection element 24 is connected mechanically to a movable contact element of at least one auxiliary contact 55. Since the switching position detection element 24 is rotatable about a rotary spindle 44, an embodiment of the at least one auxiliary contact in the form of a rotary contact is one possibility. An indication of the switching position detection element 24 which corresponds to the first position of the switching element can be tapped off as an electrical signal 54 using the auxiliary contact 55 and transmitted to switching logic and/or a monitoring unit.

On actuation of the two limit switches 20 by the switching cam 19, a predeterminable position of the switching element or at least the input section 16 being reached can be tapped off in the form of a further electrical signal 53. Depending on the embodiment of the switching device, this further signal can be used to disconnect the electric motor of the drive unit. The limit switches 20 are arranged in a selected fitting position 65 relative to the driver nut 18 of the spindle/driver nut combination and therefore the switching cam 19 thereof, depending on a rotary angle shift characteristic, in particular the total length of the flexible shaft.

The auxiliary contacts are one or more auxiliary contacts which can be triggered by a rotary movement and which require jerky triggering. This takes place via the further slotted-link control mechanism 45.

In order to be able to move the switching element 3 reliably from one first switching state into a second switching state even without a current in the emergency operating mode, the flexible shaft can be actuated manually via a hand crank 56 as well, in addition to the electric drive of the drive unit 13. The hand crank 56 can in this case be plugged onto a free end 57, facing the control aisle 7, of the input section 16 in the arrow direction.

In order to visually indicate to the user 8 the switching state of the switching device 4, the input section 16 of the flexible shaft is connected in a form-fitting manner to an optical switching position indication 59 via a second secondary gear 58. In order to be able to identify the switching state even when the drive cabinet 6 is closed, the drive cabinet has a correspondingly shaped section or a viewing window in the region of the optical switching position indication 59.

Both on the input-drive side at the input section, and on the output-drive side at the output section, the flexible shaft is connected detachably to the connection elements by means of in each case one shaft coupling 60. In the specific case, both the input section 16 and the output section 25 are rigid and are formed from at least two parts, which two parts are connected to one another in a manner fixed against rotation by an toothed coupling 60 during operation of the switching device.

At the output-drive-side end of the flexible shaft, the output section 25 of the shaft is connected to the switching pin 3 via a linear, second intermediate gear 61 in the form of a gear train. In this case, the second intermediate gear is a reduction and has an input connection 62 and an output connection 63. A rotation speed at the output connection 63 can be reduced with respect to a rotation speed at the input connection 62 by means of the second intermediate gear 61, and at the same time the second intermediate gear 61 increases a low torque at the input connection 62 to a higher torque at the output connection 63.

The rotary movement at the output connection 63 of the intermediate gear is converted into a linear movement (see double arrow) for the pin contact 3 which is mounted in linearly movable fashion via a spindle/driver nut combination 64.

Figure 10:
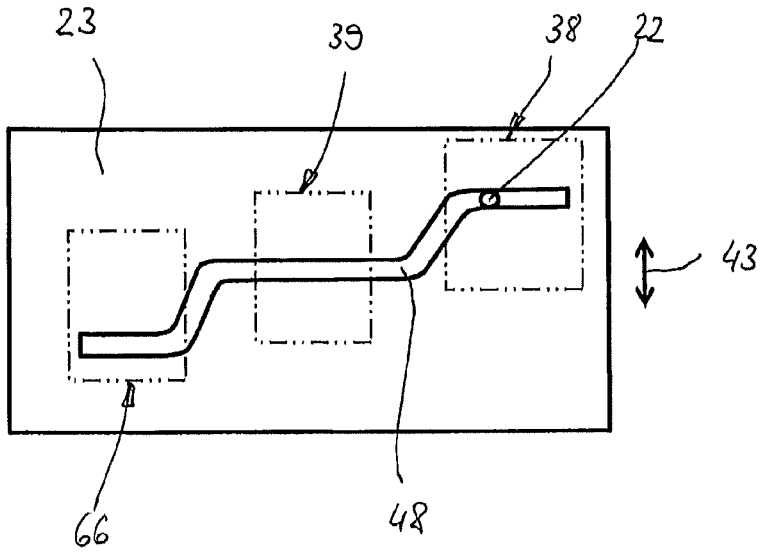
FIG. 10 shows a control means for three electrical switching positions which can be detected clearly, according to an exemplary embodiment of the present disclosure.

FIG. 10 shows a control means for three electrical switching positions which can be detected clearly, as could be used for a combined disconnector and grounding switch. In comparison with FIG. 3, identical or at least functionally identical elements have been characterized by the same reference symbols. Correspondingly, the control means 23 now has, in addition to the first region 38 and the second region 39, a third region 66, which corresponds to a third switching state of the switching device.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 Flexible shaft
2 Drive of flexible shaft
3 Movable switching element
4 Switching device
5 Switchgear assembly
6 Drive cabinet
7 Control aisle
8 Operator
9 First nominal conductor
10 Second nominal conductor
13 Drive unit with electric motor
14 First secondary gear
16 Input section of flexible shaft
17 Spindle
18 Driver nut
19 Switching cam
20 Limit switch
22 Switching journal
23 Control means/slotted link
24 Switching position detection element
25 Output section
28 First rotary angle
29 Second rotary angle
30 First rotary angle shift
31 Third rotary angle
32 Second rotary angle shift
33 Second position/switching state
34 First position/switching state
37 First intermediate gear
38 First region of control means
39 Second region of control means
40 Connecting region
43 Double arrow
44 Rotary spindle of switching position detection element
45 Further slotted-link control mechanism
46 Mating contact
47 Contact elements
48 Slot curve path
49 Overflow
53 Further electrical signal
54 Electrical signal
55 Auxiliary contact
56 Hand crank
57 Free end of input section
58 Second secondary gear
59 Optical switching position indication
60 Shaft coupling
61 Second intermediate gear
62 Input connection
63 Output connection
64 Spindle/driver nut combination
65 Fitting position
66 Third region of control means

What is claimed is:

1. A switching device comprising:

a switching element configured to be moved from a first position into a second position;

a drive unit configured to produce a rotary movement; and a flexible shaft configured to transmit the rotary movement to the switching element, wherein the flexible shaft has a first length and is mounted so as to enable rotary movement and includes a rotatable input section on an input-drive side, and a rotatable output section on an output-drive side, the input section being connected to the drive unit, wherein, during movement of the flexible shaft between the first position and the second position of the switching element, a first rotary angle is produced at the output section which is smaller than a second rotary angle at the input section at the same time, such that a first rotary angle shift is producible, wherein, during movement of the flexible shaft when the first position is reached, a third rotary angle is produced at the output section, the third rotary angle being smaller than the second rotary angle at the input section at the same time, such that a second rotary angle shift which is greater than the first rotary angle shift is producible, wherein the switching device comprises a switching position detection element and a mechanical first intermediate gear, wherein the input section is connected to the switching position detection element via the mechanical first intermediate gear, and wherein the first intermediate gear includes a control means with a first region, which corresponds to the first position of the switching element and which is coupled to the switching position detection element such that the first rotary angle shift and the second rotary angle shift in a predefinable electrical switching state of the switching device result in an identical indication of the switching position detection element.

2. The switching device as claimed in claim 1, wherein the control means has a second region, which corresponds to the second position of the switching element and which is coupled to the switching position detection element such that the first rotary angle shift and the second rotary angle shift likewise result in an identical indication of the switching position detection element.

3. The switching device as claimed in claim 1, wherein the drive unit comprises an electric motor.

4. The switching device as claimed in claim 1, wherein the switching position detection element is connected to at least one auxiliary contact such that an indication of the switching position detection element which corresponds to the first position of the switching element can be tapped off as an electrical signal at the auxiliary contact.

5. The switching device as claimed in claim 4, wherein the at least one auxiliary contact has a contact element configured to rotate about a rotary spindle.

6. The switching device as claimed in claim 1, wherein the first intermediate gear is a nonlinear gear, with which the switching position detection element is configured to be triggered nonlinearly with respect to the second rotary angle of the input section.

7. The switching device as claimed in claim 1, wherein the first region of the control means is coupled to the switching position detection element via a slotted-link control mechanism.

8. The switching device as claimed in claim 1, wherein the control means is designed in such a way that, even when using a flexible shaft with a second length which is different than the first length and therefore with a first rotary angle shift with a different magnitude and a second rotary angle shift with a different magnitude, an identical indication of the switching position detection element results.

9. The switching device as claimed in claim 1, wherein the first intermediate gear includes at least one spindle/driver nut combination configured to convert the rotary movement which is configured to be generated by the drive unit at the input section into a linear movement.

10. The switching device as claimed in claim 9, wherein, when the first position or the second position of the switching element is reached, at least one limit switch is configured to be actuated via the driver nut of the spindle/driver nut combination.

11. The switching device as claimed in claim 10, wherein the limit switch is arranged relative to the driver nut of the spindle/driver nut combination at a fitting position which is selected depending on a rotary angle shift characteristic of the flexible shaft.

12. The switching device as claimed in claim 1, wherein the flexible shaft includes at least two litz-wire layers with a different winding direction, the litz-wire layers being provided such that, given an identical second rotary angle, the first rotary angle shift or the second rotary angle shift during operation of the flexible shaft in the clockwise direction deviates from the first rotary angle shift or the second rotary angle shift during operation of the flexible shaft in the counterclockwise direction by less than 20%.

13. The switching device as claimed in claim 1, wherein at least one of the input section and the output section of the flexible shaft has a releasable further coupling, in particular a toothed coupling.

14. The switching device as claimed in claim 1, comprising:

a mechanical second intermediate gear arranged on the output section of the flexible shaft, the second intermediate gear being a reduction and having an input connection and an output connection, the second intermediate gear being configured to reduce a rotation speed of the output connection with respect to a rotation speed of the input connection.

15. The switching device as claimed in claim 1, wherein a drive comprising the drive unit has an optical switching position indication, which is connected in a manner fixed against rotation to the first intermediate gear.

16. The switching device as claimed in claim 1, wherein the switching device is a gas-insulated switching device.

17. A switchgear assembly with at least one switching device as claimed in claim 1.

18. The switching device as claimed in claim 2, wherein the drive unit comprises an electric motor.

19. The switching device as claimed in claim 18, wherein the switching position detection element is connected to at least one auxiliary contact such that an indication of the switching position detection element which corresponds to the first position of the switching element can be tapped off as an electrical signal at the auxiliary contact.

20. The switching device as claimed in claim 19, wherein the at least one auxiliary contact has a contact element configured to rotate about a rotary spindle.

21. The switching device as claimed in claim 19, wherein the first intermediate gear is a nonlinear gear, with which the switching position detection element is configured to be triggered nonlinearly with respect to the second rotary angle of the input section.

22. The switching device as claimed in claim 19, wherein the first region of the control means is coupled to the switching position detection element via a slotted-link control mechanism.

23. The switching device as claimed in claim 19, wherein the control means is designed in such a way that, even when using a flexible shaft with a second length which is different than the first length and therefore with a first rotary angle shift with a different magnitude and a second rotary angle shift with a different magnitude, an identical indication of the switching position detection element results.

24. The switching device as claimed in claim 19, wherein the first intermediate gear includes at least one spindle/driver nut combination configured to convert the rotary movement which is configured to be generated by the drive unit at the input section into a linear movement.

25. The switching device as claimed in claim 10, wherein the at least one limit switch includes an electrical limit switch.

26. The switching device as claimed in claim 11, wherein the fitting position is selected depending on a total length of the flexible shaft.

27. The switching device as claimed in claim 13, wherein the releasable further coupling includes a toothed coupling.

* * * * *